United States Patent [19]

Scarlata

[11] Patent Number: 4,635,833

[45] Date of Patent: Jan. 13, 1987

[54] PORTABLE BOOTJACK

[76] Inventor: Salvatore Scarlata, 101-02 95th Ave., Queens, N.Y. 11416

[21] Appl. No.: 799,964

[22] Filed: Nov. 20, 1985

[51] Int. Cl.[4] ..... A47J 51/02

[52] U.S. Cl. ..... 223/116; D2/642

[58] Field of Search ..... 223/116, 113, 114, 115, 223/117; D2/378.2; 74/481, 512

[56] References Cited

U.S. PATENT DOCUMENTS 374,076 11/1887 Littleton ..... 223/117 X
609,603 8/1898 Youngberg et al. ..... 223/116
611,043 9/1898 Spaid ..... 223/117 X
3,850,048 11/1974 Moore ..... 74/481 X

FOREIGN PATENT DOCUMENTS 696553 9/1940 Fed. Rep. of Germany ..... 223/116

*Primary Examiner*—Werner H. Schroeder
*Assistant Examiner*—Andrew M. Falik
*Attorney, Agent, or Firm*—Peter L. Berger

[57] ABSTRACT

A portable bootjack comprising a frame formed of articulated metal members enables the heel of a boot to be effective grabbed and held by pressure applied on a pedal plate to assist in the removal of the boot.

6 Claims, 5 Drawing Figures

FIG. 1
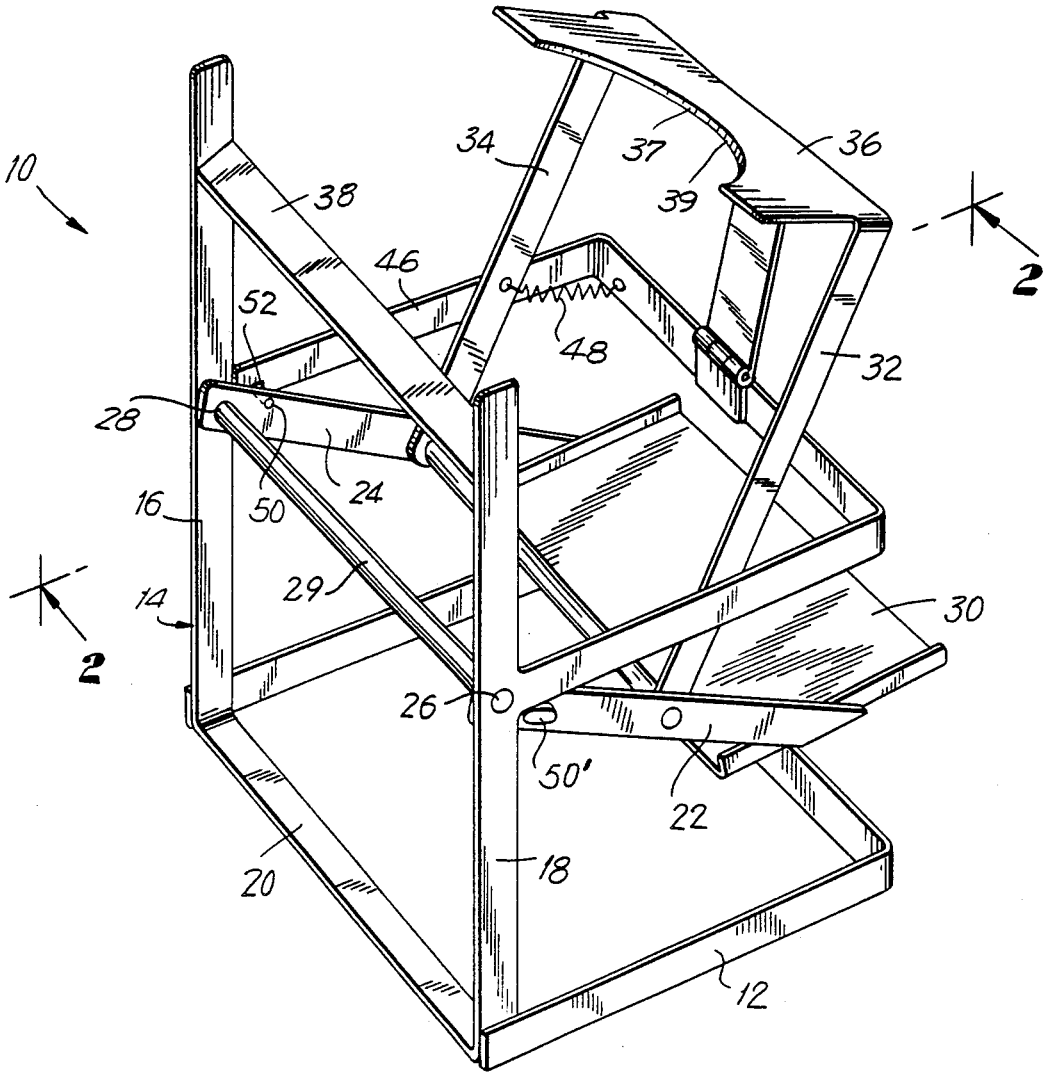
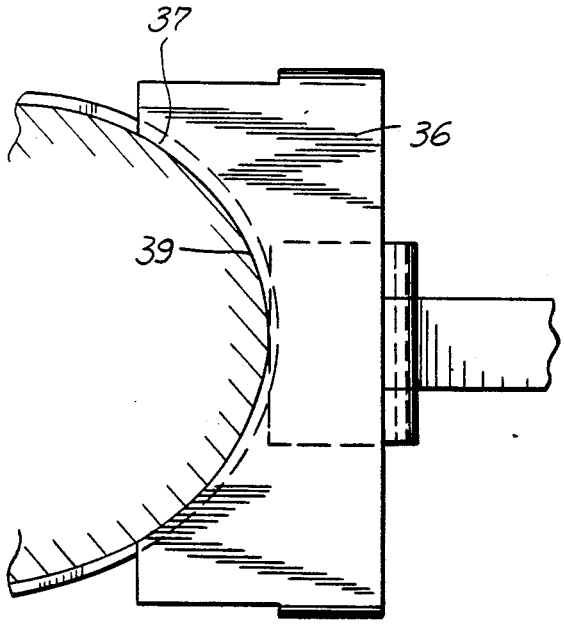
FIG. 5

PORTABLE BOOTJACK

BACKGROUND OF THE INVENTION

This invention relates to a bootjack, and more particulary, to a portable bootjack which is easy to use.

Removing boots has long been a problem for many people. Certainly, the elderly have difficulty in removing boots and shoes. Certain prior art devices as represented by the below listed patents present different schemes for assisting in the removal of such boots.

The Youngberg et al. U.S. Pat. No. 609,603 as well as the Weber U.S. Pat. No. 835,147 present relatively complicated mechanisms for assisting in the removal of the boot. These devices may not be easily portable, and comprise means to grab the entire shoe or boot when it is removed.

The patent to Massie, U.S. Pat. No. 171,398 presents another complex mechanism in which the heel of the boot is grabbed, but there is no means to grab the front portion of the heel. The gripping of the boot is rather ineffective, and this problem is also apparent in the patent to Burgess, U.S. Pat. No. 4,266,701.

The patent to Teague, U.S. Pat. No. 3,734,363 merely describes a bootjack which comprise a U-shaped frame, and there are no means to effectively hold the boot as it is being removed. The patent to Mayer, U.S. Pat. No. 3,734,364 also presents a bootjack in which the rear of the boot is grabbed in an effort to assist in the removal thereof.

None of the patents show or suggest a bootjack in which the assembly is portable yet in which one foot easily and effectively operates the bootjack to remove the boot on the other foot. The apparatus provides an effective and sure gripping of the boot by gripping the front and rear of the heel to ensure removal thereof.

An object of the present invention is provide an improved bootjack which is effective to use and may be easily used by senior citizens who have difficulty in removing boots and shoes.

Another object of this invention is provide such a bootjack which does not damage the shoe or boot being removed.

Still another object of this invention is to provide such a bootjack which securely grabs the heel of the boot to ensure that it is firmly held as the boot is removed.

Another object of this invention is to provide such an apparatus which is made of durable parts and which will lend itself to long use and efficient operation.

Another object of this invention is to provide such a bootjack which is lightweight and portable.

Another object of this invention is to provide such a bootjack which is relatively foolproof in operation, inexpensive to manufacture and susceptible of widespread use.

Other objects, advantages and features of this invention will become more apparent from the following description.

SUMMARY OF THE INVENTION

In accordance with the principles of this invention, the above objects are accomplished by providing a bootjack formed of a frame which itself comprises a vertical front frame to which there are attached articulated levers. These articulated levers cause relative movement between a foot plate and a rear gripping plate, the rear gripping plate being moved forwardly to grab the rear of the boot or rear of the heel of the boot. A front gripping or bearing surface is also provided against which the front portion of the heel of the boot is urged as the rear gripping plate pushes against the rear of the boot. A positive pressure applied on the pedal plate by one foot causes an effective gripping to occur, and an additional spring member is provided to snap the rear gripping plate firmly against the rear of the boot to secure the boot heel between the front bearing rod and rear gripping plate and ensure that the boot is effectively held as it is removed from the foot.

The device is adapted to rest on the ground, and one foot may easily bear against the pedal plate to assist the removal of the boot on the other foot. After the first boot has been removed, the operator merely reverses the position of the feet and removes the boot from the second foot.

The apparatus is adapted to be made of aluminum or other lightweight metal which is durable and which will provide long life and efficient operation.

BRIEF DESCRIPTION OF THE DRAWINGS

FIG. 1 is a perspective view of the bootjack of this invention.

FIG. 5 is a sectional view taken along lines 5—5 of FIG. 4.

DETAILED DESCRIPTION

Figures 2, 3:
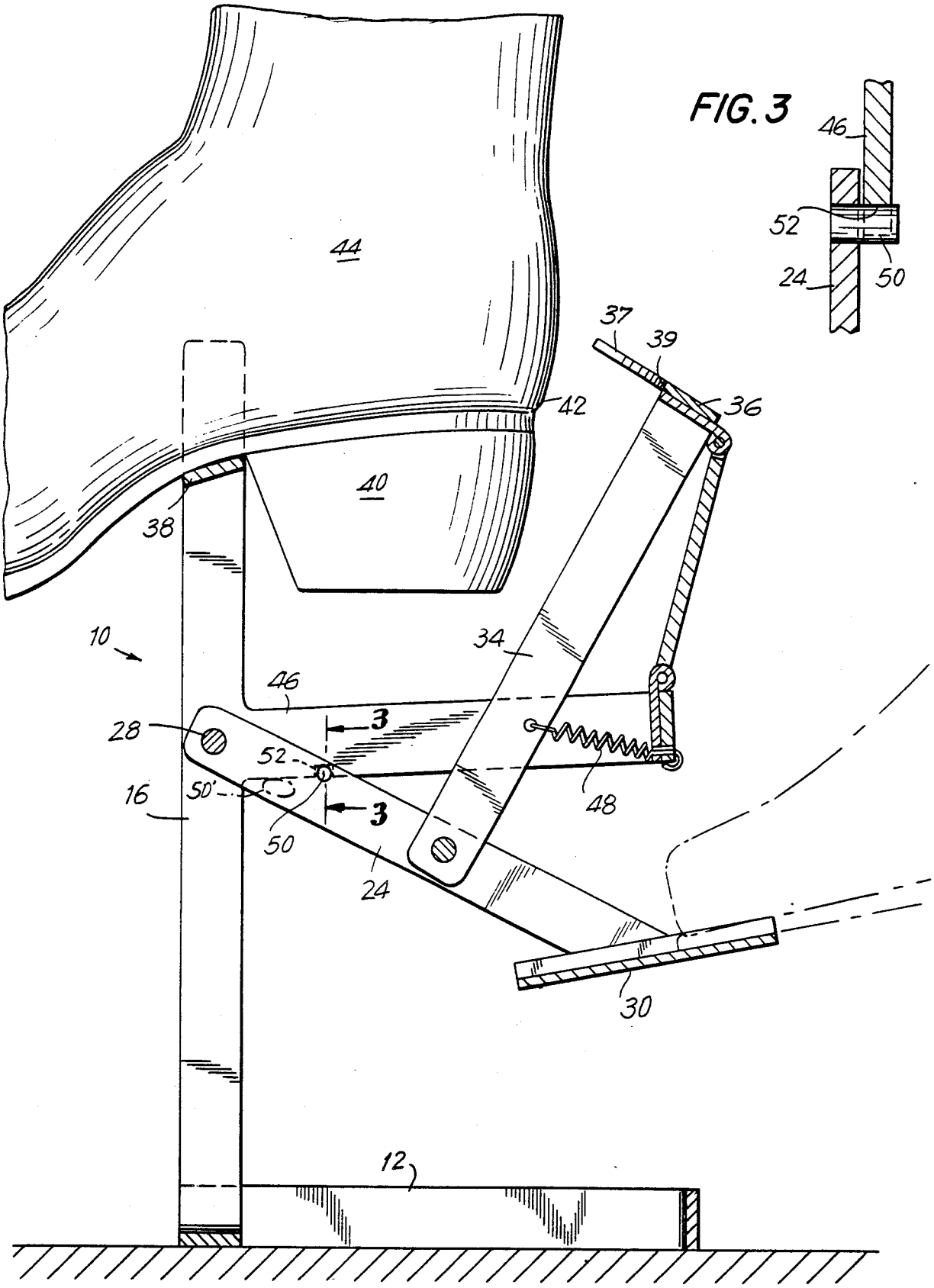
FIG. 2 is a sectional view taken along lines 2—2 of FIG. 1.
FIG. 3 is a sectional view taken along lines 3—3 of FIG. 2 illustrating a stop mechanism of the present invention.

FIG. 1 illustrates the bootjack 10 of this invention. The bootjack comprises substantially a frame or assembly which initially comprises the base frame or base rest 12 attached to a front vertical frame 14. The front vertical frame is comprised of opposite posts 16 and 18 which are attached at the front of base 12. A cross support bar 20 is provided between the vertical posts 16 and 18 to provide additional support for the base. A first pair of articulated levers 22 and 24 are hingedly connected to vertical posts as at 26 and 28, respectively. Lateral support bar 29 is shown connected between pivot points 26 and 28. A pedal plate 30 forms the lower terminus of the first pair of articulated levers, and the pedal plate 30 may be welded or secured to the articulated levers 22 and 24 or may be integrally formed therewith. A second pair of articulated levers 32 and 34 are hingedly connected to the mid-point of the first pair of articulated members 22 and 24 at their lower end, and the upper end of the second pair of articulated members 32 and 34 terminates in a rear boot gripping plate 36. The rear gripping plate 36 may be integrally formed with articulated levers 32 and 34 or may be separately formed and welded thereto. The rear boot gripping plate has a forward inwardly curved section 37 which is adapted to substantially conform to the rear of the boot or shoe, and it is adapted to be provided with a front surface 39 formed of a material which does not damage or otherwise cut or scrape the rear of the boot.

An important aspect of the present invention relates to the provision of a front gripping bar 38 connected between the vertical posts 16 and 18 against which the front of the heel 40 (FIG. 2) bears as the rear gripping plate 36 bears against the rear 42 of the boot 44 (FIG. 2).

Figure 4:
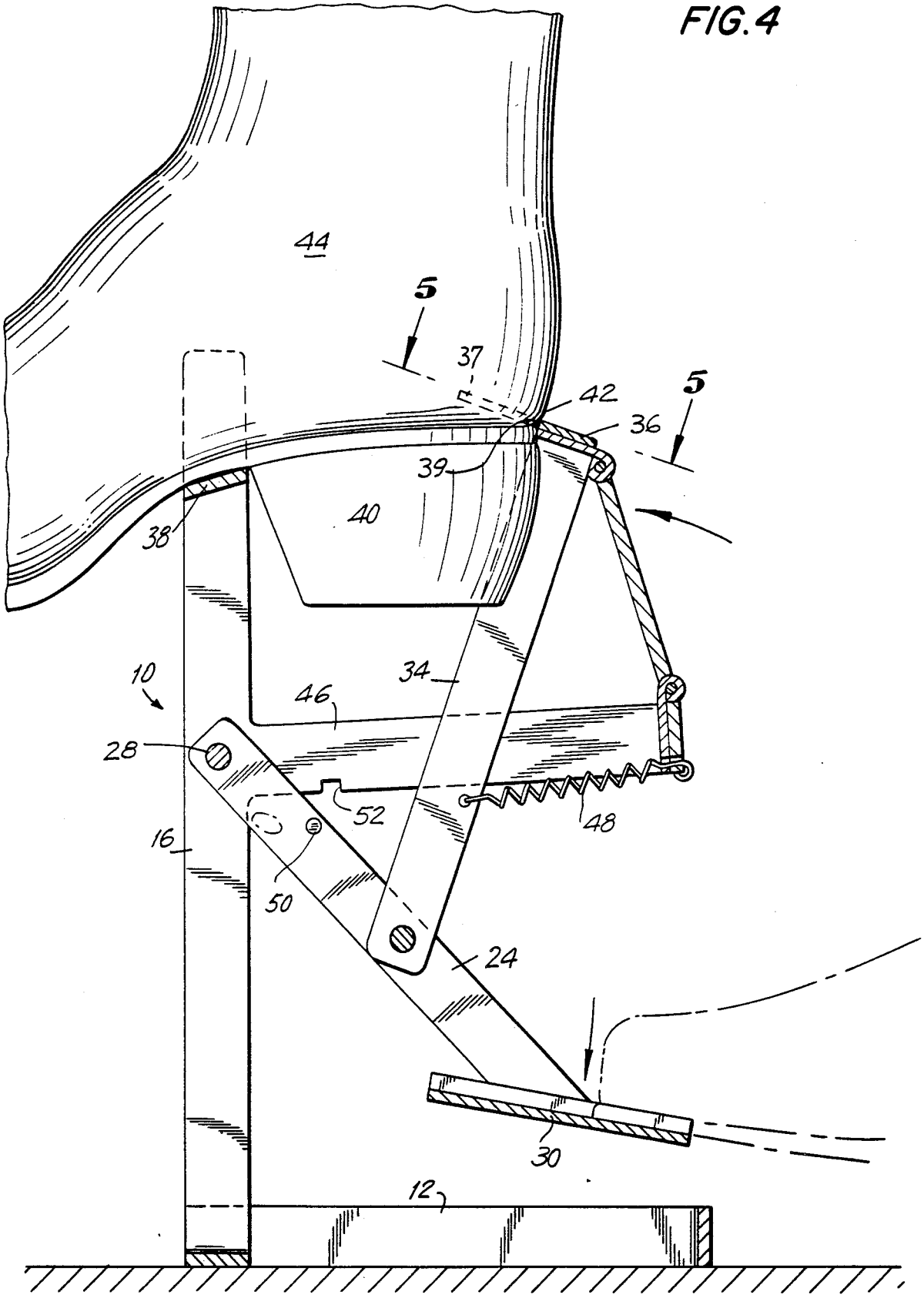
FIG. 4 is a view similar to FIG. 2 illustrating the bootjack securely grabbing the heel of the boot.

FIGS. 2 and 4 illustrate the operation of the invention more clearly in which the above described members are identified by numerals. There is illustrated the above described boot 44 having the heel 40 which is adapted to bear against the front bar 38 and will receive the rear support plate 36 as in FIG. 4.

An intermediate support frame 46 also hingedly connected to the vertical frame at hinge points 26 and 28 provides additional support and ensures that the rear gripping surface snaps against the rear of the boot through a spring means 48 which is connected between intermediate frame 46 and the second pair of articulated levers 32 and 34.

A pin 50 is provided on the outside of the first pair of articulated levers 22 and 24 and limits the amount of relative movement between the articulated members of the bootjack of this invention. The pin is illustrated in FIG. 3 and sits within a notch 52 formed within the intermediate support frame 46, an abutment stop 50' is located on the opposite end of pin 50.

This bootjack is adapted to be made of lightweight metal members, such as aluminum, and the construction of the apparatus lends itself to being manufactured inexpensively. The bootjack is lightweight and may be carried from place to place. Additionally, the pedal plate 30 is relatively easy to use, and senior citizens or others having difficulty in bending down to remove their boots may merely step on the pedal plate while seated to cause the rear gripping surface to bear against the boot and firmly hold the boot against the front bar 38 to ensure that the boot may easily be removed while the user is seated comfortably.

FIG. 5 illustrates the general shape of the rear gripping plate which is adapted to conform to the rear of the boot. The front surface 39 of the plate is adapted to be smooth and otherwise soft in order to prevent scuffing or scratching of the shoe or boot being so removed.

This invention has been described with respect to a preferred embodiment. Other changes or modifications may be made by those skilled in the art without departing from the scope of protection for the invention.

What is claimed is:

1. A bootjack assembly for facilitating removal of a boot or shoe wherein said assembly comprises a base adapted to sit on the floor, a vertical frame attached at the front of said base, a lateral front gripping bar adapted to bear against the front of the heel of the boot, a moveable rear gripping plate conforming to the shape of the rear of the boot moveable against the rear of the boot holding it firmly, a pedal plate connected to said moveable rear gripping plate, the latter being urged forwardly against the rear of the boot as the pressure is applied to said pedal plate, a first pair of articulated levers hingedly attached at opposite sides of said frame to said pedal plate, a second pair of articulated levers hingedly attached to said first pair of articulated levers, said second pair of levers forming said moveable rear gripping plate, and said pedal plate being attached to and connected between the lower end of said first pair of articularted levers.

2. A bootjack assembly as claimed in claim 1, further comprising a lateral support bar located between said opposite sides of said vertical frame at the hinge point connected between said first pair of articulated levers and said vertical frame.

3. A bootjack assembly as claimed in claim 2, further comprising an intermediate support frame hingedly connected at said hinge point connection on said vertical frame, spring means connecting said intermediate support frame to said second pair of articulated levers to enhance the pressure exerted by said moveable rear gripping plate or said boot and to lock the rear gripping plate against the rear of said boot.

4. A bootjack assembly as claimed in claim 3, further comprising stop means located on said first pair of articulated levers to control the relative movement of said articulated apparatus.

5. A bootjack assembly as claimed in claim 3, wherein said apparatus is fabricated of metal.

6. A bootjack assembly as claimed in claim 3, wherein said apparatus is portable.

* * * * *